US006663069B1

(12) United States Patent
Norberg

(10) Patent No.: US 6,663,069 B1
(45) Date of Patent: Dec. 16, 2003

(54) FLEXIBLE MOLDED PLASTIC HANGER

(76) Inventor: John Norberg, 120 E. Quartz Rock Rd., Phoenix, AZ (US) 85027

( * ) Notice: Subject to any disclaimer, the term of this patent is extended or adjusted under 35 U.S.C. 154(b) by 22 days.

(21) Appl. No.: 10/253,370

(22) Filed: Sep. 23, 2002

Related U.S. Application Data

(60) Provisional application No. 60/339,603, filed on Oct. 26, 2001.

(51) Int. Cl.[7] ..... A47G 1/10

(52) U.S. Cl. ..... 248/316.7; 248/231.81; 248/229.26; 24/339; 24/341

(58) Field of Search ..... 248/229.16, 231.81, 248/228.7, 214, 511–518, 534–541, 229.26, 316.7, 224.7, 225.21; 52/272, 687, 699, 28, 219; D8/394; 24/336, 337, 341, 531; 362/147, 152, 249, 432, 806

(56) References Cited

U.S. PATENT DOCUMENTS

| | | | | | |
|---|---|---|---|---|---|
| 2,869,812 | A | * | 1/1959 | Hamel | |
| 3,664,626 | A | * | 5/1972 | Sneller | |
| 5,688,428 | A | * | 11/1997 | Maguire | 249/91 |
| 5,700,083 | A | * | 12/1997 | Boechel | 362/249 |
| 6,017,014 | A | * | 1/2000 | Maguire | 249/91 |
| 6,076,938 | A | * | 6/2000 | Kinderman | 362/249 |
| D431,182 | S | * | 9/2000 | Szukhent | D8/394 |
| D432,905 | S | * | 10/2000 | Sutker et al. | D8/394 |

* cited by examiner

*Primary Examiner*—Gwendolyn Baxter
(74) *Attorney, Agent, or Firm*—Joseph H. Roediger; Gregory J. Nelson

(57) ABSTRACT

A flexible molded hanger for removable placement on the top of masonry walls to support Christmas lights and other displays. The hanger is bowed to facilitate placement and provided with a central pediment to receive a stabilizing member. Retention chips are formed on the hanger at spaced locations.

10 Claims, 2 Drawing Sheets

FLEXIBLE MOLDED PLASTIC HANGER

CROSS REFERENCE TO RELATED APPLICATION

The present application is based on provisional patent application Ser. No. 60/339,603 filed Oct. 26, 2001.

BACKGROUND OF THE INVENTION

This invention relates to a flexible molded plastic hanger for removable placement on the top of parapet or masonry walls to receive strings of Christmas lights, garlands, banners and the like.

In the southwestern United States, the use of parapet and masonry walls to outline a property line or to serve as compliments to different parts of buildings and homes are commonplace. The walls are typically made of wood or concrete block with a thin finishing coat applied thereto. The construction of these decorative walls has limited the ability of the homeowner to attach decorative accents to the walls since the thin masonry coating on the wall does not readily accept intrusive devices such as nails or countersunk fasteners. The use of these types of fastening devices has been found to create damage to the surface coating and often to the underlying wood and block with results that are much larger than is aesthetically acceptable. Furthermore, the use of intrusive devices generally means that the positioning fasteners are left in place after the decorations are removed. To alter the decorating theme at a later time requires the use of additional fasteners compounding the problem.

The present invention has as a primary objective the provision of a removable attachment for the top of a parapet or masonry wall which supports decorative accents at different locations on the wall. The present device enables the user to easily place individual articles at desired locations on the wall and to continue with a sequence varying the space between based on the length and width of the articles to be supported. Typically, the subject invention is used in connection with the stringing of electric lights during the end of the year holiday season. The spacing can be readily changed because the devices are movable along the top of the wall to accommodate lighter streamers and garlands as well as heavier banners. In addition, the device places retention clips on both sides of the wall as well as a retention guide on the top. Each retention clip and guide is provided with a detent that retains the wire or line running through it.

SUMMARY OF THE INVENTION

The removable support for suspending articles upon a parapet or masonry wall which is the subject of the invention includes a substantially planar strip for placement across the top of the wall. At each end of the planar strip are first and second flexible resilient side strips depending therefrom. The side strips have an inwardly curved region along their length. The curved region forms the contact area for the side of the parapet or masonry wall when the support is in position.

A retention clip is provided on the outer surface of the side clip for supporting an article such as wire, cord or other line therein. The retention clip has a detent which retains the line when urged into place. The retention clip as well as the side strips and planar strip are formed of flexible resilient material, preferably a single unitary molded device.

The side strips are preferably outwardly bowed from their connection to the planar strip. In this embodiment, the planar strip is made wider than the corresponding dimension of the standard wood or concrete block used in the construction of parapet and masonry walls. As a result, the planar strip extends outwardly beyond the side surface of the conventional parapet or masonry wall. The side strips are outwardly bowed proximate to their juncture with the planar strip and inwardly bowed thereafter. By outwardly bowing the upper portion of the flexible resilient side strips, the device can be readily placed upon a parapet or masonry wall of varying finishes without requiring significant force to position the device on the wall. The inwardly bowed portion engages the adjacent surface of the parapet or masonry wall to maintain the position during use.

In other embodiments of the invention, the side strips may be made linear to fit along the side of the wall. In addition, the substantially planar strip may include a bow to conform to the top of a wall having a contoured top surface.

Further features and advantages of the invention will become more readily apparent from the following description of a preferred embodiment as shown in the accompanying drawings.

DESCRIPTION OF THE PREFERRED EMBODIMENT

Figure 1:
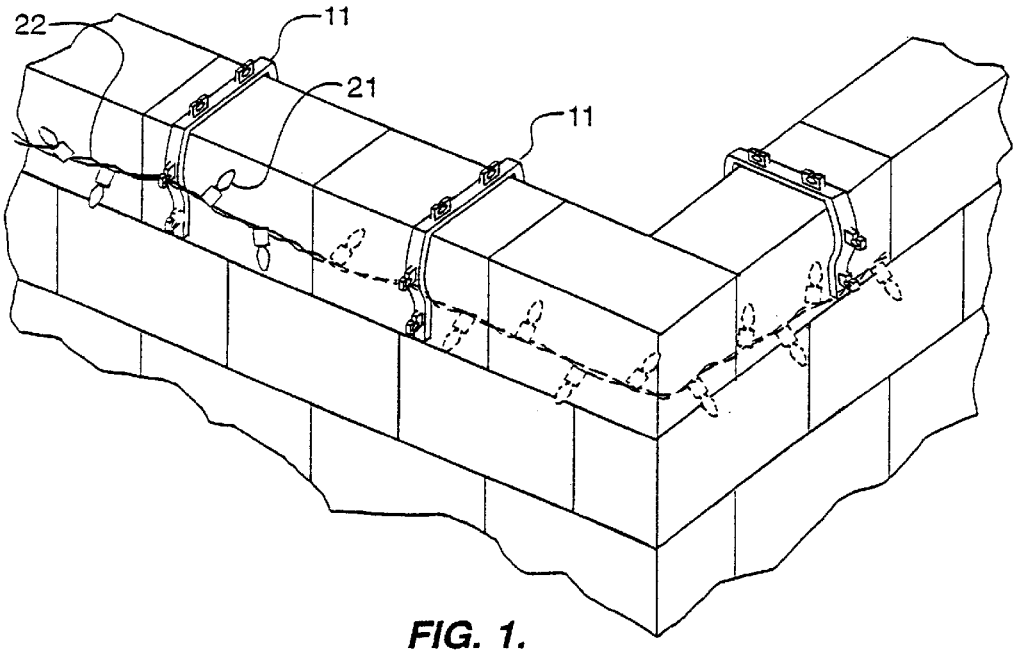
FIG. 1 is a partial view in perspective showing a preferred embodiment of the invention mounted on a wall.

In FIG. 1, a number of flexible hangers 11 are positioned along the topmost region of a parapet or concrete block wall. A string of decorative lights 21 interconnected by wires 22 is suspended from the hangers 11 in a position generally parallel to the top of the wall. The hangers are in frictional engagement with the surface of the wall and are readily removable when the time for decoration has passed.

Figure 2:
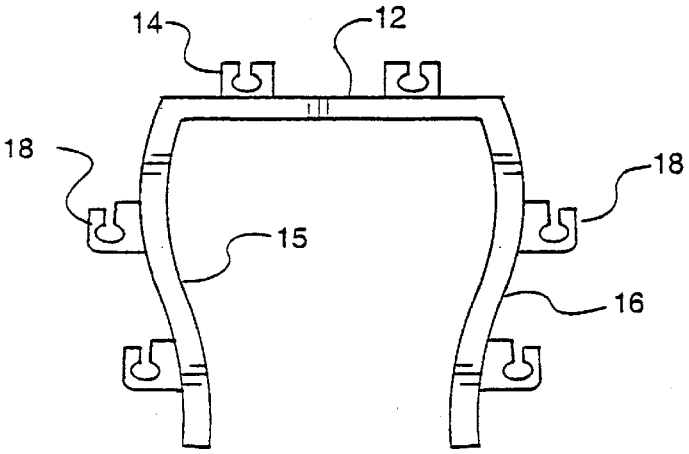
FIG. 2 is a plain view of the embodiment of FIG. 1.
Figure 3:
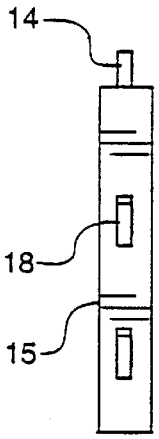
FIG. 3 is a side view of the embodiment of FIG. 2.

Referring now to FIGS. 2 and 3, the present invention is shown as a molded plastic hanger formed of flexible plastic material. The subject invention includes a substantially planar strip 12 having two guide clips 14 on the upper surface thereof. Side strips 15 and 16 are shown depending from the opposing ends of the planar strip. These ends will be outwardly flexed at the time of placement over the top of a parapet or masonry wall.

In the preferred embodiment, the side strips are shown outwardly bowed in the region proximate to the planar strip and thereafter inwardly bowed. A slight flare is shown at the free-end of each of these strips. The strips 15 and 16 are shown identical in design. The planar strip is intended to rest on the top of a parapet or masonry wall and is made oversized for the conventional wood and concrete block used in parapet and masonry wall construction. The outward flaring facilitates placement and the inward bowing provides the engaging force against the surface of the parapet or masonry wall to limit inadvertent movement during use. The slight outward flare is shown just to facilitate placement in the event the user does not exert sufficient force to spread the free ends further apart than the wall is thick.

The planar strip is shown provided with a pair of guide clips 14 laterally spaced and formed on the exposed or upper surface thereof. The guide clip has a central opening which is partially closed so that a wire or line urged into the guide clip is retained. The side strips 15 and 16 are each provided with retention clips 18 having a similar detent feature to their design. The generally J-shaped retention clip of the preferred embodiment is molded integrally with the entire device. As a result, the molded plastic hanger has a degree of flexibility in all of its design features.

To employ the hanger, the free-ends of the side strips 15 and 16 are urged outwardly in the direction of the arrows of FIG. 2 and the hanger is placed on the top of the parapet or masonry wall. A series of hangers is located at intermediate distances based on the type of decorative accent being suspended from the hangers. Thus, a string of Christmas lights is readily suspended from the J-shaped side strips and a different type of accent can be used in the other of the retention clips. If desired, the light string can be run along the top of the parapet or masonry wall using the guide clips 14.

Figure 4:
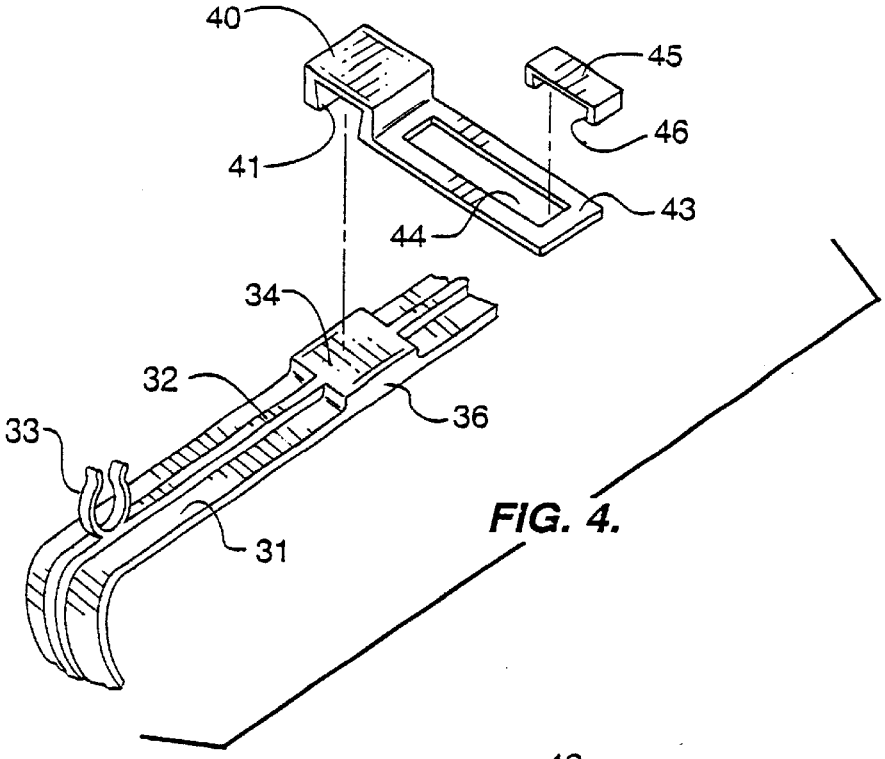
FIG. 4 is a view in perspective of another embodiment of the invention and a stabilizer clip and locking clip for use therewith.
Figure 5:
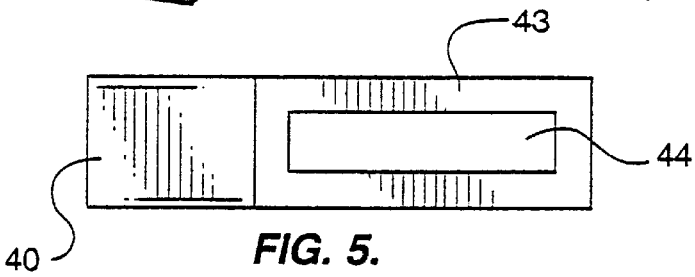
FIG. 5 is a top view of the stabilizer clip of FIG. 4.
Figure 7:
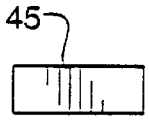
FIG. 7 is a top view of the locking clip of FIG. 4.

An alternative embodiment is shown in FIG. 4 wherein a strengthening rib 32 with guide clip 33 formed thereon is centrally located on the outer surface of hanger 31. A raised pediment 34 is located at the approximate midpoint of the upper surface of the hanger. The pediment has inwardly tapered sidewalls 36 to receive the outwardly tapered walls 41 of stabilizer clip 40. The stabilizer clip 40 is formed from material having the same flexible resilient characteristics of hanger 31 so as to be readily urged on to the pediment 34.

Figure 6:
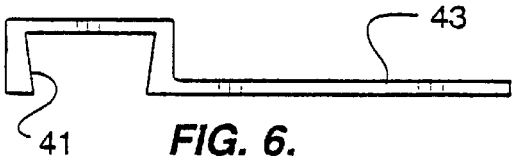
FIG. 6 is a side view of the stabilizer clip of FIG. 5.
Figure 8:
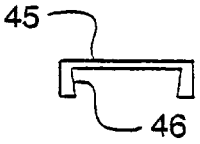
FIG. 8 is a side view of the locking clip of FIG. 7.

The stabilizer clip is affixed to a hanger to stabilize a hanger subjected to unequal loading or a change in the direction of the applied load. The stabilizing clip 40 is provided with a lateral extension 43 having a slot 44 therein. The end walls of slot 44 are tapered as shown in FIG. 6 to receive the tapered interior walls 46 of locking clip 45.

Figure 9:
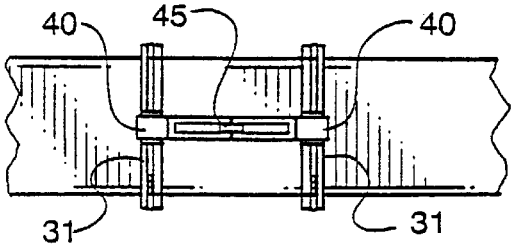
FIG. 9 is a plain view showing adjacent hangers interlocked by the stabilizer and locking clips.

The locking clip 45 is used to connect adjacent stabilizing clips 40 as shown in FIG. 9. The use of the hangers for large loads which change direction often tend to promote movement of the last hanger on a wall before the change of direction. The interconnection of hangers inhibits movement of the last hanger and provides stability for the display. The locking clip 45 is snapped into place when needed as shown in FIG. 9 and can be readily removed along with the stabilizer clips 40 when the display is to be taken down. The embodiment of FIG. 4 is provided with U-shaped guide clips 33 with a substantial central opening allowing for use of the hangers with large diameter cords and lines.

While the above description has referred to a specific embodiment of the invention, it is to be noted that modifications and variations may be made therein without departing from the scope of the invention as set forth in the accompanying claims.

What is claimed is:

1. A removable fixture for placement across the top of a masonry wall, said fixture providing support for a cord running along the top and sides of the wall, said fixture comprising:

a. an elongated support for conformably resting on the top of said wall, said support having opposing ends and a length at least as great as the width of said wall;

b. a guide clip affixed to the support and oriented to receive a cord running along the top of the wall, said guide clip removably receiving the cord passing therethrough;

c. first and second flexible resilient side strips depending from opposing ends of the elongated support, said side strips having a curved region along a portion of the length thereof, said curved region contacting the side of the masonry wall; and d. a retention clip affixed to the outer surfaces of a side strip and oriented to receive a cord passing therethrough, said guide clip and retention clip being formed of flexible resilient material.

2. The removable fixture of claim 1 wherein said guide clip and retention clip have a detent therein for retaining the cord in position along the wall.

3. The removable fixture of claim 2 further comprising a retention clip formed on each of said side strips.

4. The removable fixture of claim 3 further comprising a pair of spaced guide clips affixed to the elongated support.

5. The removable fixture of claim 4 wherein said fixture is formed of a flexible plastic.

6. A removable fixture for placement across the top of a masonry wall, said fixture providing support for cords running along the top and side of the wall, said fixture comprising:

a. an elongated support for conformably resting on the top of said wall, said support having opposing ends and a length at least as great as the width of said wall;

b. a guide clip affixed to the support and oriented to receive a cord running along the top of the wall, said guide clip removably receiving the cord passing therethrough;

c. first and second flexible resilient side strips depending from opposing ends of the elongated strip, said side strips having a curved region along a portion of the length thereof, said curved region contacting the side of the masonry wall;

d. a retention clip affixed to the outer surfaces of a side strip and oriented to receive a cord passing therethrough, said guide clip and retention clip being formed of flexible resilient material; and e. a centrally-located pediment formed on said elongated support, said pediment having a pair of inwardly tapered sidewalls for receiving a stabilizing clip thereon.

7. The removable support of claim 6 further comprising a strengthening rib extending along the outer surface of the elongated strip.

8. The removable support of claim 7 further comprising a stabilizing clip having tapered internal walls for mating engagement with the side walls of the pediment.

9. The removable support of claim 8 wherein said stabilizing clip includes a lateral extension for contacting the wall.

10. The removable support of claim 9 wherein the lateral extension of the stabilizing clip includes a slot for receiving a locking clip therein, the locking clip engaging the stabilizing clip of adjacent removable supports.

* * * * *